US008900024B2

(12) United States Patent
Jenney

(10) Patent No.: US 8,900,024 B2
(45) Date of Patent: Dec. 2, 2014

(54) INFLATABLE BATHING SUIT SYSTEM

(71) Applicant: Neil Jenney, New York, NY (US)

(72) Inventor: Neil Jenney, New York, NY (US)

( * ) Notice: Subject to any disclaimer, the term of this patent is extended or adjusted under 35 U.S.C. 154(b) by 224 days.

(21) Appl. No.: 13/726,773

(22) Filed: Dec. 26, 2012

(65) Prior Publication Data

US 2014/0179182 A1 Jun. 26, 2014

(51) Int. Cl.

| | |
|---|---|
| ***A41D 7/00*** | (2006.01) |
| ***A41D 13/012*** | (2006.01) |
| ***B63C 9/125*** | (2006.01) |
| ***B63C 9/15*** | (2006.01) |

(52) U.S. Cl.

CPC ..... *A41D 7/005* (2013.01); *A41D 13/012* (2013.01); *A41D 7/003* (2013.01); *B63C 9/125* (2013.01); *B63C 9/155* (2013.01); *Y10S 2/03* (2013.01)

USPC ..... 441/120; 2/67; 2/DIG. 3

(58) Field of Classification Search

CPC ..... A41D 7/001; A41D 7/003; A41D 7/005; A41D 13/012; B63C 9/087; B63C 9/105; B63C 9/1055; B63C 9/11; B63C 9/125; B63C 9/15

USPC ..... 2/67, DIG. 3; 441/88, 102–124

See application file for complete search history.

(56) References Cited

U.S. PATENT DOCUMENTS

| | | | | | |
|---|---|---|---|---|---|
| 2,490,556 | A * | 12/1949 | Spack | ..... | 441/120 |
| 2,524,212 | A * | 10/1950 | Spack | ..... | 441/120 |
| 2,888,691 | A * | 6/1959 | Manning | ..... | 441/109 |
| 3,098,248 | A * | 7/1963 | Geier | ..... | 441/120 |
| 3,130,424 | A * | 4/1964 | Santangelo | ..... | 441/94 |
| 6,231,411 | B1 * | 5/2001 | Vinay | ..... | 441/120 |
| 8,104,096 | B1 * | 1/2012 | Jenney | ..... | 2/67 |

* cited by examiner

*Primary Examiner* — Ajay Vasudeva

(57) ABSTRACT

Pants have top and bottom and intermediate extents, a front and a rear, and left and right sides. The top extent has a small torus and a large torus. Left and right fasteners are in the large torus. First and second bladders are in the large torus adjacent to the left side. Third and fourth bladders are in the large torus adjacent to the right side. A left tube is operatively coupled the first and second bladder. A right tube is operatively coupled to the third and fourth bladder.

5 Claims, 3 Drawing Sheets

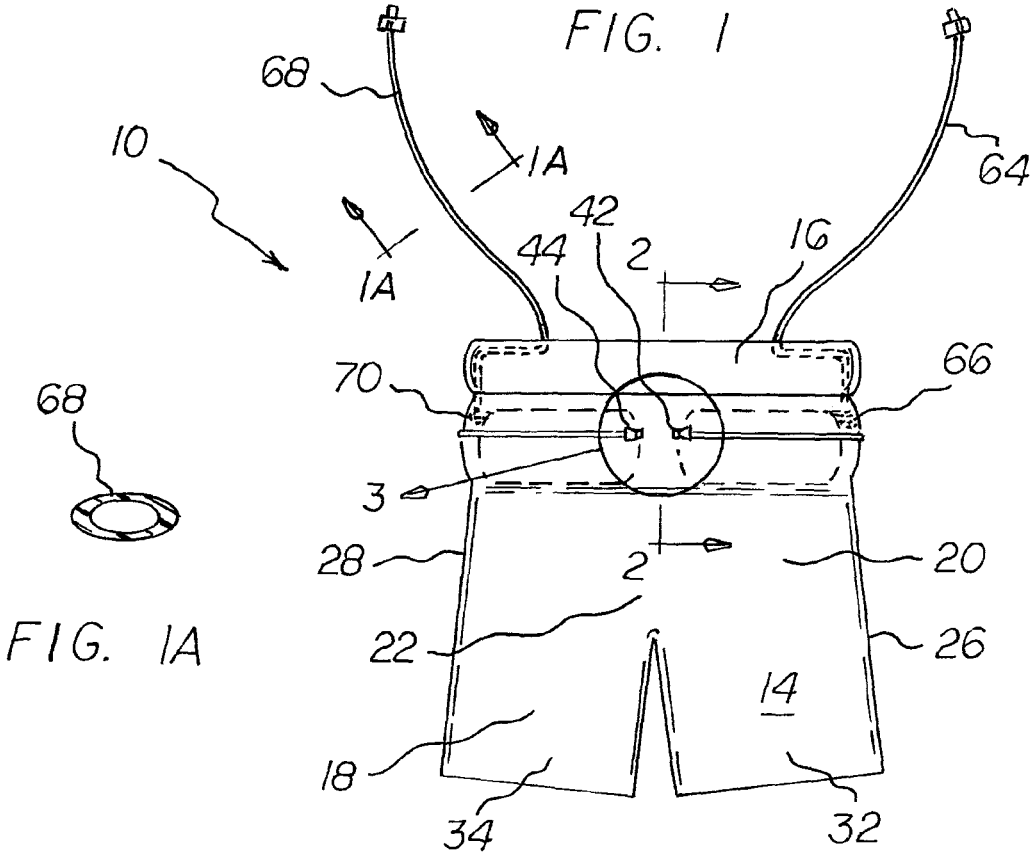
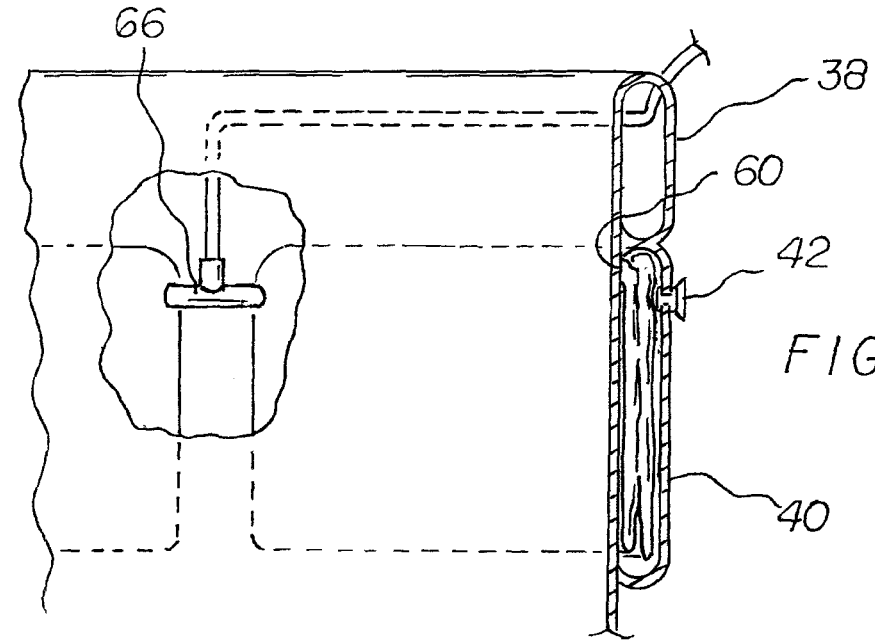
FIG. 1A
FIG. 2

FIG. 3
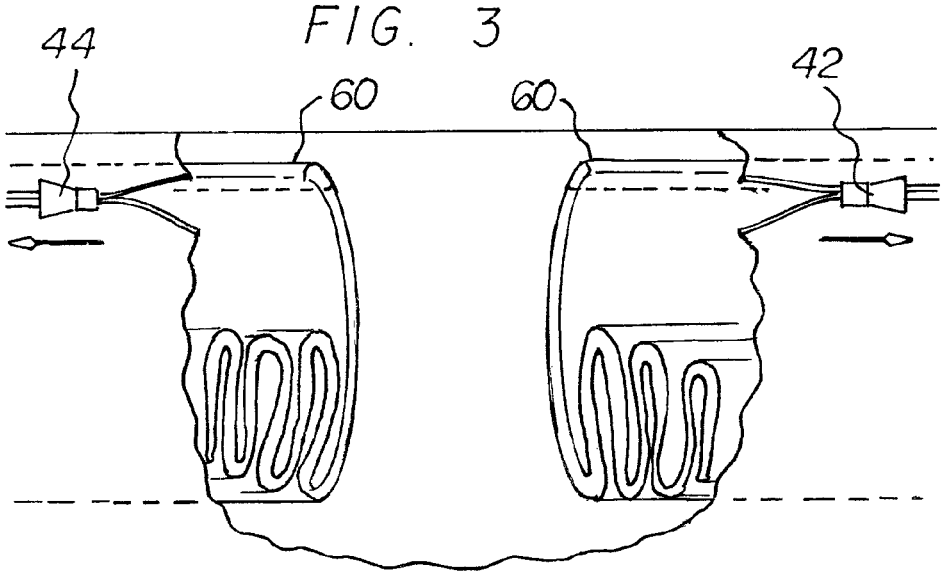
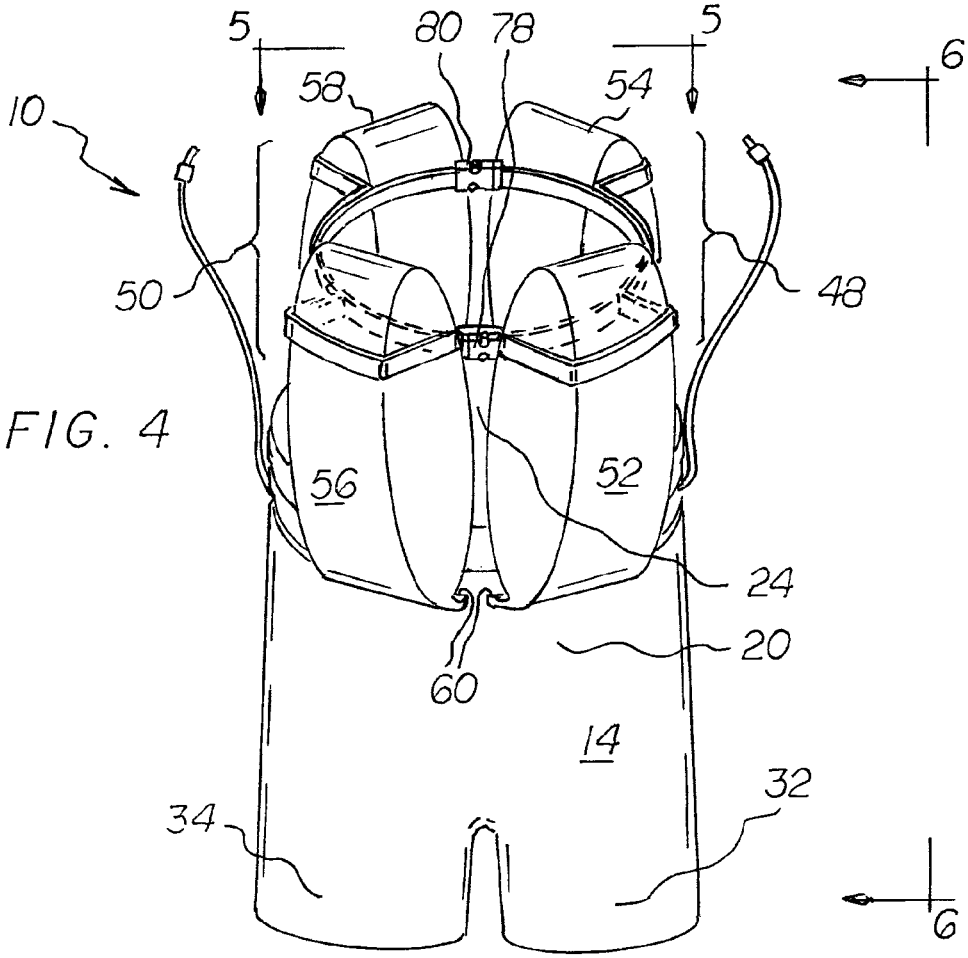
FIG. 4

FIG. 5
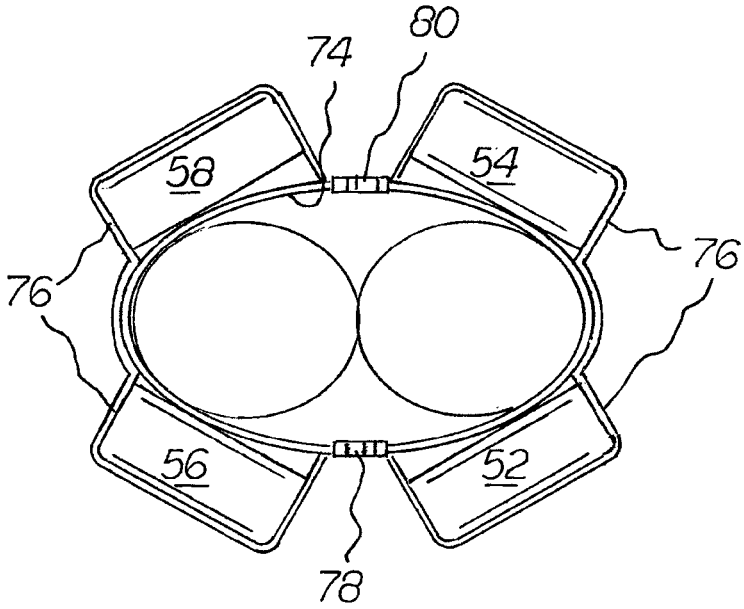
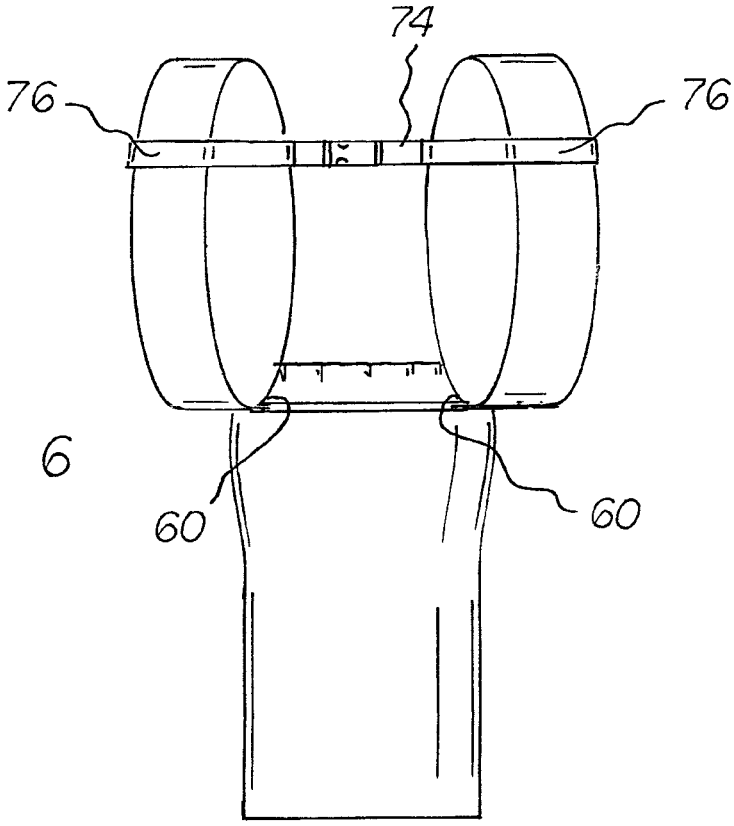
FIG. 6

INFLATABLE BATHING SUIT SYSTEM

BACKGROUND OF THE INVENTION

1. Field of the Invention

The present invention relates to a inflatable bathing suit system and more particularly pertains to clothing a wearer and selectively providing buoyancy to the wearer at the discretion of the wearer in a safe, convenient, economical and eye appealing manner.

2. Description of the Prior Art

The use of inflatable bathing suit systems of known designs and configurations is known in the prior art. More specifically, inflatable bathing suit systems of known designs and configurations previously devised and utilized for the purpose of clothing and providing buoyancy to a wearer are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, they do not describe a inflatable bathing suit system that allows for clothing a wearer and for selectively providing buoyancy to the wearer at the discretion of the wearer.

In this respect, the inflatable bathing suit system according to the present invention substantially departs from the conventional concepts and designs of the prior art, and in doing so provides an apparatus primarily developed for the purpose of for clothing a wearer and for selectively providing buoyancy to the wearer at the discretion of the wearer.

Therefore, it can be appreciated that there exists a continuing need for a new and improved inflatable bathing suit system which can be used for clothing a wearer and for selectively providing buoyancy to the wearer at the discretion of the wearer. In this regard, the present invention substantially fulfills this need.

SUMMARY OF THE INVENTION

In view of the foregoing disadvantages inherent in the known types of inflatable bathing suit systems of known designs and configurations now present in the prior art, the present invention provides an improved inflatable bathing suit system. As such, the general purpose of the present invention, which will be described subsequently in greater detail, is to provide a new and improved inflatable bathing suit system and method which has all the advantages of the prior art and none of the disadvantages.

To attain this, the present invention essentially comprises pants having top and bottom and intermediate extents, a front and a rear, and left and right sides. The top extent has a small torus and a large torus. Left and right fasteners are in the large torus. First and second bladders are in the large torus adjacent to the left side. Third and fourth bladders are in the large torus adjacent to the right side. A left tube is operatively coupled the first and second bladder. A right tube is operatively coupled to the third and fourth bladder.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved inflatable bathing suit system which has all of the advantages of the prior art inflatable bathing suit systems of known designs and configurations and none of the disadvantages.

It is another object of the present invention to provide a new and improved inflatable bathing suit system which may be easily and efficiently manufactured and marketed.

It is further object of the present invention to provide a new and improved inflatable bathing suit system which is of durable and reliable constructions.

An even further object of the present invention is to provide a new and improved inflatable bathing suit system which is susceptible of a low cost of manufacture with regard to both materials and labor, and which accordingly is then susceptible of low prices of sale to the consuming public, thereby making such inflatable bathing suit system economically available to the buying public.

Lastly, it is an object of the present invention to provide a new and improved inflatable bathing suit system for clothing a wearer and for selectively providing buoyancy to the wearer at the discretion of the wearer, the clothing and the providing of buoyancy being done in a safe, convenient, economical and eye-appealing manner These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of an inflatable bathing suit system constructed in accordance with the principles of the present invention.

FIG. 1A is a cross sectional view taken along line 1A-1A of FIG. 1.

FIG. 2 is a cross sectional view taken along line 2-2 of FIG. 1.

FIG. 3 is an enlarged illustration taken at Circle 3 of FIG. 1.

FIG. 4 is a perspective illustration of the system shown in a deployed inflated orientation.

FIG. 5 is a plan view of the system taken alone line 5-5 of FIG. 4.

FIG. 6 is a side elevational view of the system taken along line 6-6 of FIG. 4.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved inflatable bathing suit system embodying the principles and concepts of the present invention and generally designated by the reference numeral 10 will be described.

The present invention, the inflatable bathing suit system 10 is comprised of a plurality of components. Such components in their broadest context include pants; first, second, third and fourth bladders; and left and right tubes. Such components are individually configured and correlated with respect to each other so as to attain the desired objective.

The inflatable bathing suit system 10 is for clothing a wearer and for selectively providing buoyancy to the wearer at the discretion of the wearer. The clothing and providing of buoyancy are done in a safe, convenient, economical and eye-appealing manner. First provided are swimming pants 14 fabricated of a water repellant polymer. The swimming pants have a top extent 16 above and a bottom extent 18 below. The swimming pants also have an intermediate extent 20 between the top and bottom extents. The pants have a front 22, a rear 24, a left side 26, and a right side 28.

The intermediate extent is positionable around the hips of the wearer.

The lower extent has a left leg portion 32 and a right leg portion 34. The left and right leg portions are integrally fabricated with the intermediate extent.

The top extent has a generally annular small torus 38 with a hollow interior. The top extent also has a generally annular large torus 40 having a hollow interior. The large torus is located between the small torus and the intermediate extent. The large torus is integrally formed with the small torus and the intermediate extent. A central axis extends generally vertically through the top and intermediate extents. A left leg axis extends generally vertically through the left leg. A right leg axis extends generally vertically through the right leg.

A left zipper 42 is located in the large torus in a generally horizontal plane along the left side of the pants to selectively provide a left access opening to the interior of the large torus. The left access opening extends for between 160 and 178 degrees.

A right zipper 44 is located in the large torus in a generally horizontal plane along the right side of the pants to selectively provide a right access opening to the interior of the large torus. The right access opening extends for between 160 and 178 degrees.

Next provided is a bladder assembly. The bladder assembly includes a left subassembly 48 and a right subassembly 50. The left subassembly includes a first bladder 52 in the large torus adjacent to the left side forwardly. The left subassembly also includes a second bladder 54 in the large torus adjacent to the left side rearwardly.

The right subassembly includes a third bladder 56 in the large torus adjacent to the right side forwardly. The right subassembly also includes a fourth bladder 58 in the right torus adjacent to the right side rearwardly.

The first and second bladders have an uninflated stowed orientation within the large torus on the left side. The third and fourth bladders have an uninflated stowed orientation within the large torus on the right side. All of the bladders having an inflated deployed orientation extending upwardly of the swimming pants. Each bladder has an upper end 60 attached to the swimming pants within the large torus. The bladders are fabricated of an inflatable elastomeric polymer.

Next provided is a tube assembly. The tube assembly has a left tube 64 and an associated left T-shaped fitting 66. The left T-shaped fitting is operatively coupled to the first and second bladders pneumatically with the left tube. The left tube has an interior end attached to the left T-shaped fitting. The left tube has a free exterior end above the small torus. The left tube has an intermediate extent within the small torus.

The tube assembly has a right tube 68 and an associated right T-shaped fitting 70. The right T-shaped fitting is operatively coupled to the third and fourth bladders pneumatically with the right tube. The right tube has an interior end attached to the right T-shaped fitting. The right tube has a free exterior end above the small torus. The right tube has an intermediate extent within the small torus.

Wearer controlled clamps are adjacent to the free exterior ends of the left and right tubes. Each clamp is adapted to be opened for inflation and deflation purposes. Each clamp is adapted to be closed for precluding inflation and deflation.

Lastly, a belting assembly is provided. The belting assembly includes an interior belt 74 and four exterior belts 76. The four exterior belts are attached to the interior belt at circumferentially spaced locations. In this manner four reception areas are formed for constraining movement of the bladders. The interior belt has a front buckle 78 and a rear buckle 80. Note FIGS. 4, 5 and 6.

The bladders and the belting assembly are within the large torus with the left and right zippers closing the access openings when in the uninflated orientation. The bladders and the belting assembly are exterior of the large torus with the left and right zippers opening the access openings when in the inflated orientation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An inflatable bathing suit system comprising:

pants having top and bottom and intermediate extents, the pants having a front and a rear and left and right side;

the top extent having a small torus and a large torus, left and right fasteners in the large torus;

first and second bladders in the large torus adjacent to the left side, third and fourth bladders in the large torus adjacent to the right side; and a left tube operatively coupled to the first and second bladders, a right tube operatively coupled to the third and fourth bladders, wherein the left tube and the right tube extend through the small torus.

2. The system as set forth in claim 1 and further including:

a belting assembly including an interior belt and four exterior belts attached to the interior belt at circumferentially spaced locations to form four reception areas for constraining movement of the bladders, the bladders and the belting assembly being within the large torus when in the uninflated orientation, the bladders and the belting assembly being exterior of the large torus when in the inflated orientation.

3. The system as set forth in claim 2 wherein the majority of each of the tubes is within the small torus when in the uninflated orientation and wherein the minority of each of the the tubes is above the small torus when inflating.

4. The system as set forth in claim 1 and further including:

a left T-shaped fitting operatively coupling the first and second bladders with the left tube and a right T-shaped fitting operatively coupling the third and fourth bladders with the left tube.

5. An inflatable bathing suit system (10) for clothing a wearer and for selectively providing buoyancy to the wearer at the discretion of the wearer, the clothing and the providing of buoyancy being done in a safe, convenient, economical and eye-appealing manner, the system comprising, in combination:

swimming pants (14) fabricated of a water repellant polymer, the swimming pants having a top extent (16) above and a bottom extent (18) below and an intermediate extent (20) between the top and bottom extents, the pants having a front (22) and a rear (24) and a left side (26) and a right side (28);

the intermediate extent being positionable around the hips of the wearer;

the lower extent having a left leg portion (32) and a right leg portion (34), the left and right leg portions being integrally fabricated with the intermediate extent;

the top extent having a generally annular small torus (38) with a hollow interior, the top extent having a generally annular large torus (40) having a hollow interior, the large torus being located between the small torus and the intermediate extent, the large torus being integrally formed with the small torus and the intermediate extent, a central axis extending generally vertically through the top and intermediate extents, a left leg axis extending generally vertically through the left leg, a right leg axis extending generally vertically through the right leg, a left zipper (42) located in the large torus in a generally horizontal plane along the left side of the pants to selectively provide a left access opening to the interior of the large torus, the left access opening extending for between 160 and 178 degrees, a right zipper (44) located in the large torus in a generally horizontal plane along the right side of the pants to selectively provide a right access opening to the interior of the large torus, the right access opening extending for between 160 and 178 degrees;

a bladder assembly including a left subassembly (48) and a right subassembly (50), the left subassembly including a first bladder (52) in the large torus adjacent to the left side forwardly and a second bladder (54) in the large torus adjacent to the left side rearwardly, the right subassembly including a third bladder (56) in the large torus adjacent to the right side forwardly and a fourth bladder (58) in the right torus adjacent to the right side rearwardly, the first and second bladders having an uninflated stowed orientation within the large torus on the left side, the third and fourth bladders having an uninflated stowed orientation within the large torus on the right side, all of the bladders having an inflated deployed orientation extending upwardly of the swimming pants, each bladder having an upper end (60) attached to the swimming pants within the large torus, the bladders being fabricated of an inflatable elastomeric polymer;

a tube assembly having a left tube (64) and an associated left T-shaped fitting (66), the left T-shaped fitting operatively coupling the first and second bladders pneumatically with the left tube, the left tube having an interior end attached to the left T-shaped fitting, the left tube having a free exterior end above the small torus, the left tube having an intermediate extent within the small torus, the tube assembly having a right tube (68) and an associated right T-shaped fitting (70), the right T-shaped fitting operatively coupling the third and fourth bladders pneumatically with the right tube, the right tube having an interior end attached to the right T-shaped fitting, the right tube having a free exterior end above the small torus, the right tube having an intermediate extent within the small torus, wearer controlled clamps adjacent to the free exterior ends of the left and right tubes, each clamp adapted to be opened for inflation and deflation purposes, each clamp adapted to be closed for precluding inflation and deflation; and a belting assembly including an interior belt (74) and including four exterior belts (76) attached to the interior belt at circumferentially spaced locations to form four reception areas for constraining movement of the bladders, the interior belt having a front buckle (78) and a rear buckle (80), the bladders and the belting assembly being within the large torus with the left and right zippers closing the access openings when in the uninflated orientation, the bladders and the belting assembly being exterior of the large torus with the left and right zippers opening the access openings when in the inflated orientation.

* * * * *